US009938482B2

(12) United States Patent
Utaka

(10) Patent No.: US 9,938,482 B2
(45) Date of Patent: Apr. 10, 2018

(54) LUBRICATING OIL COMPOSITION FOR INTERNAL COMBUSTION ENGINE

(71) Applicant: IDEMITSU KOSAN CO., LTD., Chiyoda-ku (JP)

(72) Inventor: Toshimasa Utaka, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/113,931

(22) PCT Filed: Jan. 26, 2015

(86) PCT No.: PCT/JP2015/052084
§ 371 (c)(1),
(2) Date: Jul. 25, 2016

(87) PCT Pub. No.: WO2015/111746
PCT Pub. Date: Jul. 30, 2015

(65) Prior Publication Data

US 2016/0348027 A1 Dec. 1, 2016

(30) Foreign Application Priority Data

Jan. 27, 2014 (JP) ..... 2014-012231

(51) Int. Cl.
*C10M 161/00* (2006.01)
*C10M 167/00* (2006.01)

(52) U.S. Cl.
CPC ..... *C10M 161/00* (2013.01); *C10M 167/00* (2013.01); *C10M 2207/262* (2013.01); *C10M 2209/084* (2013.01); *C10M 2219/046* (2013.01); *C10M 2219/068* (2013.01); *C10M 2227/09* (2013.01); *C10N 2210/01* (2013.01); *C10N 2210/02* (2013.01); *C10N 2210/06* (2013.01); *C10N 2230/02* (2013.01); *C10N 2230/52* (2013.01); *C10N 2230/68* (2013.01); *C10N 2230/74* (2013.01); *C10N 2240/10* (2013.01)

(58) Field of Classification Search
CPC ..... C10M 161/00; C10M 167/00; C10M 2207/262; C10M 2209/084; C10M 2219/046; C10M 2219/068; C10M 2227/09; C10N 2210/01; C10N 2210/02; C10N 2210/06; C10N 2230/02; C10N 2230/52; C10N 2230/68; C10N 2230/74; C10N 2240/10
USPC ..... 508/365
See application file for complete search history.

(56) References Cited

U.S. PATENT DOCUMENTS

| | | | | |
|---|---|---|---|---|
| 6,500,786 | B1 | 12/2002 | Hartley et al. | |
| 2003/0134758 | A1* | 7/2003 | Bovington | C10M 163/00 508/525 |
| 2010/0093578 | A1 | 4/2010 | Tsujimoto et al. | |
| 2011/0160106 | A1* | 6/2011 | Carrick | C10M 159/20 508/287 |
| 2012/0071373 | A1* | 3/2012 | Matsui | C10M 145/14 508/364 |
| 2012/0135900 | A1 | 5/2012 | Matsui et al. | |
| 2012/0283159 | A1 | 11/2012 | Matsui et al. | |
| 2014/0221260 | A1* | 8/2014 | Herz | C10M 141/02 508/175 |
| 2015/0175927 | A1 | 6/2015 | Utaka et al. | |

FOREIGN PATENT DOCUMENTS

| | | | |
|---|---|---|---|
| EP | 2 439 257 | A1 | 4/2012 |
| EP | 2 522 709 | A1 | 11/2012 |
| EP | 2 610 333 | A1 | 7/2013 |
| JP | 2003-193086 | A | 7/2003 |
| JP | 2007-217494 | A | 8/2007 |
| JP | 2008-24845 | A | 2/2008 |
| JP | 2008-184569 | A | 8/2008 |
| JP | 2010-37421 | A | 2/2010 |
| JP | 2013-199594 | A | 10/2013 |
| JP | 2013-203913 | A | 10/2013 |
| WO | WO 2014/021350 | A1 | 2/2014 |

OTHER PUBLICATIONS

International Search Report dated Apr. 21, 2015 in PCT/JP2015/052084, filed Jan. 26, 2015.
Extended European Search Report dated Jul. 28, 2017 in Patent Application No. 15740818.8.

* cited by examiner

*Primary Examiner* — James Goloboy
(74) *Attorney, Agent, or Firm* — Oblon, McClelland, Maier & Neustadt, L.L.P.

(57) ABSTRACT

A lubricating oil composition for an internal combustion engine according to the present invention contains a lubricating base oil, (A1) a basic calcium salicylate having a TBN of 200 mgKOH/g or more, (A2) a basic sodium sulfonate having a TBN of 200 mgKOH/g or more and/or a basic calcium sulfonate having a TBN of 50 mgKOH/g or less, (B) a binuclear organic molybdenum compound and/or a trinuclear organic molybdenum compound, and (C) a polyalkyl (meth)acrylate having an SSI of 30 or less, a total content of molybdenum derived from the binuclear and trinuclear organic molybdenum compounds being 0.025 mass % or more relative to the whole amount of the composition and the lubricating oil composition having predetermined values of a high-temperature high-shear viscosity and a NOACK value (250° C., 1 hr).

21 Claims, No Drawings

LUBRICATING OIL COMPOSITION FOR INTERNAL COMBUSTION ENGINE

TECHNICAL FIELD

The present invention relates to a lubricating oil composition for an internal combustion engine, and more particularly to a lubricating oil composition for an internal combustion engine having a decreased viscosity.

BACKGROUND ART

In recent years, environmental regulations are becoming more and more stringent on a global scale. In particular, the circumstances surrounding automobiles, including fuel efficiency requirements and exhaust emission regulations, are becoming increasingly difficult. Behind this, there are environmental issues such as global warming, and resource protection arising from concerns about the depletion of petroleum resources. For these reasons, it is believed that further reduction of fuel consumption in automobiles will be pursued. To reduce fuel consumption in automobiles, improvement of engine oil, such as decrease of viscosity thereof, addition of a good friction modifier, etc., for the purpose of reducing friction loss in an engine, is as important as improvement of automobiles in themselves, such as weight reduction of automobiles, engine improvement, etc.

For example, PTL 1 discloses a lubricating oil composition for an internal combustion engine, which has a high-temperature high-shear viscosity at 150° C. of 2.6 mPa·s and a high-temperature high-shear viscosity at 100° C. of 5.5 to 5.9 mPa·s, thereby enabling the fuel efficiency in an internal combustion engine to be improved, and which is obtained by adding a polymethacrylate-based viscosity index improver, a salicylate-based metal detergent, a molybdenum-based friction modifier, and so on to a mineral oil-based base oil having a relatively low viscosity.

CITATION LIST

Patent Literature

PTL 1: JP 2007-217494 A

SUMMARY OF INVENTION

Technical Problem

By the way, in recent years, the demand for reduction of fuel consumption is further increasing because of environmental regulations and so on, and therefore, a further decrease of viscosity of lubricating oils used in internal combustion engines, such as gasoline engines, diesel engines, gas engines, etc., that comply with environmental regulations is under consideration.

However, in a lubricating oil composition having a decreased viscosity, conventionally, it was difficult to enhance high-temperature oxidation stability and detergency while ensuring high wear prevention properties and fuel consumption reducing properties. For example, if the viscosity of a lubricating oil is further decreased while utilizing the formulation of PTL 1 as it is, some problems, such as deterioration in high-temperature oxidation stability or detergency, are generated.

The present invention has been made in view of the foregoing circumstances, and an object of the present invention is to improve high-temperature oxidation stability and detergency of a lubricating oil composition having a decreased viscosity which is used for an internal combustion engine while ensuring high wear prevention properties and reduction of fuel consumption.

Solution to Problem

In order to solve the foregoing problem, the present inventor made extensive and intensive investigations. As a result, it has been found that the foregoing problem can be solved by blending a specified metal-based detergent, a specified organic molybdenum compound, and a specified viscosity index improver in a lubricating oil composition for an internal combustion engine having a decreased viscosity, thereby leading to accomplishment of the present invention as described below.

Namely, the present invention provides the following (1) to (7).

(1) A lubricating oil composition for an internal combustion engine, containing:

a lubricating base oil;

(A1) a basic calcium salicylate having a total base number, as measured by a perchloric acid method, of 200 mgKOH/g or more;

(A2) a basic sodium sulfonate having a total base number, as measured by a perchloric acid method, of 200 mgKOH/g or more and/or a basic calcium sulfonate having a total base number, as measured by a perchloric acid method, of 50 mgKOH/g or less;

(B) a binuclear organic molybdenum compound represented by the following general formula (I) and/or a trinuclear organic molybdenum compound represented by the following general formula (II); and (C) a polyalkyl (meth)acrylate having an SSI of 30 or less, a total content of molybdenum derived from the binuclear and trinuclear organic molybdenum compounds being 0.025 mass % or more relative to the whole amount of the composition, and the lubricating oil composition having a high-temperature high-shear viscosity at 100° C. of 4.0 to 5.0 mPa·s, a high-temperature high-shear viscosity at 150° C. of 2.5 mPa·s or less, and a NOACK value (250° C., 1 hr) of 15 mass % or less.

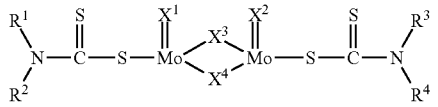

(I)

In the formula (I), each of $R^1$ to $R^4$ represents a hydrocarbon group having 4 to 22 carbon atoms, and $R^1$ to $R^4$ may be the same as or different from each other; and each of $X^1$ to $X^4$ represents a sulfur atom or an oxygen atom.

$$Mo_3S_kL_nQ_z \quad \text{(II)}$$

In the formula (II), each of Ls independently represents a ligand having an organic group containing a carbon atom, and at least 21 carbon atoms are present in total in all the organic groups of the ligands; n is 1 to 4; k is 4 to 7; Q represents a neutral electron donating compound; and z is 0 to 5 and includes non-stoichiometric values.

(2) The lubricating oil composition for an internal combustion engine as set forth above in (1), containing an organic molybdenum compound in an amount of 0.04 to 0.1 mass % in terms of a molybdenum content relative to the whole amount of the composition.

(3) The lubricating oil composition for an internal combustion engine as set forth above in (1) or (2), containing the polyalkyl (meth)acrylate in an amount of 2 to 20 mass % relative to the whole amount of the composition.

(4) The lubricating oil composition for an internal combustion engine as set forth above in any of (1) to (3), containing at least the basic sodium sulfonate having a total base number, as measured by a perchloric acid method, of 200 mgKOH/g or more as the component (A2).

(5) The lubricating oil composition for an internal combustion engine as set forth above in (4), further containing the basic calcium sulfonate having a total base number, as measured by a perchloric acid method, of 50 mgKOH/g or less as the component (A2).

(6) The lubricating oil composition for an internal combustion engine as set forth above in any of (1) to (5), further containing a mononuclear organic molybdenum compound.

(7) A production method of a lubricating oil composition for an internal combustion engine according to the present invention is concerned with a method for producing a lubricating oil composition for an internal combustion engine, which includes blending:

(A1) a basic calcium salicylate having a total base number, as measured by a perchloric acid method, of 200 mgKOH/g or more;

(A2) a basic sodium sulfonate having a total base number, as measured by a perchloric acid method, of 200 mgKOH/g or more and/or a basic calcium sulfonate having a total base number, as measured by a perchloric acid method, of 50 mgKOH/g or less;

(B) a binuclear organic molybdenum compound represented by the following general formula (I) and/or a trinuclear organic molybdenum compound represented by the following general formula (II); and (C) a polyalkyl (meth)acrylate having an SSI of 30 or less, in a lubricating base oil, so as to produce a lubricating oil composition for an internal combustion engine, wherein in the lubricating oil composition for an internal combustion engine, a total content of molybdenum derived from the binuclear and trinuclear organic molybdenum compounds is 0.025 mass % or more relative to the whole amount of the composition, and the lubricating oil composition for an internal combustion engine has a high-temperature high-shear viscosity at 100° C. of 4.0 to 5.0 mPa·s, a high-temperature high-shear viscosity at 150° C. of 2.5 mPa·s or less, and a NOACK value (250° C., 1 hr) of 15 mass % or less.

(I)

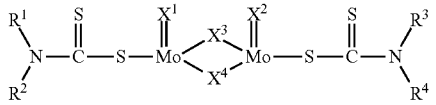

In the formula (I), each of $R^1$ to $R^4$ represents a hydrocarbon group having 4 to 22 carbon atoms, and $R^1$ to $R^4$ may be the same as or different from each other; and each of $X^1$ to $X^4$ represents a sulfur atom or an oxygen atom.

$$Mo_3S_kL_nQ_z \quad (II)$$

In the formula (II), each of Ls independently represents a ligand having an organic group containing a carbon atom, and at least 21 carbon atoms are present in total in all the organic groups of the ligands; n is 1 to 4; k is 4 to 7; Q represents a neutral electron donating compound; and z is 0 to 5 and includes non-stoichiometric values.

Advantageous Effects of Invention

In accordance with the present invention, it is possible to improve high-temperature oxidation stability and detergency in a lubricating oil composition for an internal combustion engine having a decreased viscosity, while ensuring wear resistance and fuel consumption reducing performance.

DESCRIPTION OF EMBODIMENTS

A preferred embodiment of the present invention is hereinafter described in detail.

[Lubricating Oil Composition for Internal Combustion Engine]

A lubricating oil composition for an internal combustion engine (which may be hereinafter referred to simply as "lubricating oil composition") according to the present embodiment contains a lubricating oil base oil; (A1) a basic calcium salicylate having a TBN of 200 mgKOH/g or more, and (A2) a basic sodium sulfonate having a TBN of 200 mgKOH/g or more and/or a basic calcium sulfonate having a TBN of 50 mgKOH/g or less, as (A) a metal-based detergent; (B) an organic molybdenum compound at least including a binuclear organic molybdenum compound and/or a trinuclear organic molybdenum compound as a friction modifier; and (C) a polyalkyl (meth)acrylate as a viscosity index improver.

TBN refers to a total base number as measured by a perchloric acid method in conformity with JIS K2501.

The lubricating oil composition has a high-temperature high-shear viscosity (HTHS viscosity) at 150° C. of 2.5 mPa·s or less, and a high-temperature high-shear viscosity (HTHS viscosity) at 100° C. of 4.0 to 5.0 mPa·s. When the lubricating oil composition has HTHS viscosities at 150° C. and 100° C. in the foregoing ranges, the fuel consumption reducing properties of the lubricating oil composition can be improved easily.

The HTHS viscosity at 150° C. is preferably 2.0 to 2.5 mPa·s, and more preferably 2.2 to 2.5 mPa·s. The HTHS viscosity at 100° C. is preferably 4.0 to 4.75 mPa·s.

The lubricating oil composition has a NOACK value (250° C., 1 hr) of 15 mass % or less. When the NOACK value is more than 15 mass %, the lubricating oil composition has poor high-temperature oxidation stability and thus tends to undergo an increase in viscosity and so on. The NOACK value (250° C., 1 hr) is preferably 10 mass % or more for an improvement of fuel consumption reducing properties.

[Lubricating Base Oil]

The lubricating base oil which is used in the present invention is not particularly limited, and an arbitrary mineral oil or synthetic oil conventionally used as a base oil of lubricating oil can be appropriately selected and used.

Examples of the mineral oil include a mineral oil refined by subjecting a lubricating oil distillate that is obtained by distilling under reduced pressure an atmospheric residue given by atmospheric distillation of crude oil, to one or more treatments selected from solvent deasphalting, solvent extraction, hydro-cracking, solvent dewaxing, catalytic dewaxing, and hydrorefining, and the like.

Meanwhile, examples of the synthetic oil include polyolefins, such as polybutene, an α-olefin homopolymer or copolymer (e.g., an ethylene-α-olefin copolymer), etc.; various esters, such as a polyol ester, a dibasic acid ester, a phosphate ester, etc.; various ethers, such as a polyphenyl ether, etc.; polyglycols; alkylbenzenes; alkylnaphthalenes; base oils produced by isomerizing a wax or GTL WAX; and the like. Of those synthetic oils, in particular, polyolefins and polyol esters are preferred.

In the present invention, the aforementioned mineral oils may be used singly or in combination of two or more kinds as the base oil. In addition, the aforementioned synthetic oils may be used singly or in combination of two or more kinds as the base oil. Furthermore, one or more kinds of the mineral oils and one or more kinds of the synthetic oils may be used in combination as the base oil.

In the lubricating oil composition, the lubricating base oil is contained in an amount of generally 70 mass % or more, preferably 70 to 97 mass %, and more preferably 70 to 95 mass % relative to the whole amount of the lubricating oil composition.

Although the viscosity of the lubricating base oil is not particularly limited, a kinematic viscosity thereof at 100° C. is preferably in the range of from 2.0 to 10 $mm^2/s$, and more preferably in the range of from 2.2 to 6.5 $mm^2/s$.

When the kinematic viscosity at 100° C. is regulated to the foregoing range, the viscosity of the lubricating oil composition is decreased, and the HTHS viscosities at 100° C. and 150° C. of the lubricating oil composition can be easily regulated to the predetermined range as described above.

Furthermore, the lubricating base oil has a viscosity index of preferably 100 or more, more preferably 120 or more, and still more preferably 130 or more. When the viscosity index is made high as 100 or more, a change in viscosity of the lubricating base oil with a change in temperature becomes small.

The lubricating base oil has a % Cp as measured by ring analysis of preferably 75% or more, more preferably 80% or more, and still more preferably 85% or more. When the % Cp is 75% or more, the lubricating composition can have high-temperature oxidation stability. The term "% Cp as measured by ring analysis" refers to a proportion (percentage) of paraffin components calculated by the ring analysis n-d-M method and is measured in conformity with ASTM D-3238.

[Component (A)]

In the present invention, the lubricating oil composition is one containing, as the metal-based detergent (A), (A1) a basic calcium salicylate having a TBN of 200 mgKOH/g or more; and (A2) a basic sodium sulfonate having a TBN of 200 mgKOH/g or more and/or a basic calcium sulfonate having a TBN of 50 mgKOH/g or less.

The basic calcium salicylate (component (A1)) having a relatively high TBN has relatively high detergency, and hence, it is preferred as the metal-based detergent. However, if the component (A1) were used singly as the component (A) in the composition of the present invention, the high-temperature oxidation stability would be deteriorated, and the desired fuel consumption reducing properties might not be realized. Thus, in the present invention, in addition to the component (A1), the component (A2), such as a basic sodium sulfonate, etc., is combined and used. Due to this, the high-temperature oxidation stability is enhanced to prevent an increase in viscosity, and the fuel consumption reducing performance is realized, while keeping the detergency high.

The total base number (TBN) of the basic calcium salicylate which is used as the component (A1) is preferably 200 to 500 mgKOH/g, more preferably 200 to 400 mgKOH/g, and especially preferably 200 to 350 mgKOH/g. When the TBN is less than 200 mgKOH/g, the detergency is insufficient, and it is necessary to increase the amount, and therefore, disadvantages, such as insufficient fuel consumption reducing properties caused by deterioration in viscosity properties, etc., are easily generated. When the TBN is more than 500 mgKOH/g, a precipitate is liable to be formed.

Examples of the basic calcium salicylate that is the component (A1) include those in which a calcium salt of an alkyl salicylic acid, such as a dialkyl salicylic acid, etc., is used, and the calcium salt is basified. The alkyl group constituting the alkyl salicylic acid is a linear or branched alkyl group having preferably 4 to 30 carbon atoms, and more preferably 6 to 18 carbon atoms.

In the present invention, the component (A2) having a predetermined TBN is used in addition to the aforementioned component (A1). Due to this, the high-temperature oxidation stability is enhanced, and the detergency is enhanced without increasing the viscosity. Specifically, the TBN of the basic sodium sulfonate which is used as the component (A2) is 200 mgKOH/g or more, and preferably 200 to 500 mgKOH/g. The TBN of the basic sodium sulfonate is more preferably higher than the TBN of the component (A1), and specifically, it is more preferably 300 to 500 mgKOH/g, and especially preferably 400 to 500 mgKOH/g.

When the TBN is less than 200 mgKOH/g, the high-temperature oxidation stability does not become good and thus an increase in viscosity is caused, thereby generating disadvantages, such as easy formation of a precipitate, etc. because it is necessary to increase the blending amount. When the TBN is more than 500 mgKOH/g, a precipitate is liable to be formed.

The TBN of the basic calcium sulfonate which is used as the component (A2) is 50 mgKOH/g or less, preferably 5 to 50 mgKOH/g, and more preferably 10 to 30 mgKOH/g. When the TBN of the basic calcium sulfonate is more than 50 mgKOH/g, disadvantages, such as deterioration in the high-temperature oxidation stability or detergency, are generated. When the TBN of the basic calcium sulfonate is 5 mgKOH/g or more, the oxidation stability and the detergency are easily improved, and hence, such is preferred.

As the basic sodium sulfonate, those obtained by basifying a sodium salt of a sulfonic acid of various kinds may be used. As the basic calcium sulfonate, those obtained by basifying a calcium salt of a sulfonic acid of various kinds may be used.

Examples of the sulfonic acid which is used in each of the basic sodium sulfonate and the basic calcium sulfonate include aromatic petroleum sulfonic acids, alkyl sulfonic acids, aryl sulfonic acids, alkylaryl sulfonic acids, and the like. Specific examples thereof may include dodecylbenzenesulfonic acid, dilaurylcetylbenzenesulfonic acid, paraffin wax-substituted benzenesulfonic acid, polyolefin-substituted benzenesulfonic acid, polyisobutylene-substituted benzenesulfonic acid, naphthalenesulfonic acid, and the like.

In the present invention, it is preferred to incorporate the basic sodium sulfonate having a TBN of 200 mgKOH/g or more as the component (A2) into the lubricating oil composition from the standpoint that the oxidation stability and the detergency can be enhanced in a relatively small content. It is preferred to blend both the basic sodium sulfonate having a TBN of 200 mgKOH/g or more and the basic calcium sulfonate having a TBN of 50 mgKOH/g or less therein from the standpoint that the oxidation stability and the detergency can be more enhanced.

The basic calcium salicylate (A1) having a TBN of 200 mgKOH/g or more is contained in an amount of preferably 0.5 to 5.0 mass %, and more preferably 1.0 to 3.5 mass % on the basis of the whole amount of the composition. When the component (A1) is contained in an amount of 0.5 mass % or more, the function as the detergent can be thoroughly exhibited and the high-temperature oxidation stability can be more enhanced with combining the component (A2). When the amount of the component (A1) is controlled to 5.0 mass % or less, the function corresponding to the addition amount is exhibited.

When the basic sodium sulfonate having a TBN of 200 mgKOH/g or more is contained in the lubricating oil composition, its content may be smaller than the aforementioned content of the component (A1), and it is preferably 0.05 to 2.0 mass %, and more preferably 0.10 to 0.70 mass % on the basis of the whole amount of the composition. When the basic sodium sulfonate having a TBN of 200 mgKOH/g or more is contained in an amount of 0.05 mass % or more, the function as the metal detergent can be thoroughly exhibited, and the high-temperature oxidation stability can be more enhanced. When it is controlled to 2.0 mass % or less, the function corresponding to the addition amount can be exhibited.

When the basic calcium sulfonate having a TBN of 50 mgKOH/g or less is contained in the lubricating oil composition, its content may be smaller than the aforementioned content of the component (A1), and it is preferably 0.15 to 3.0 mass %, and more preferably 0.30 to 1.5 mass % on the basis of the whole amount of the composition. When the basic calcium sulfonate having a TBN of 50 mgKOH/g or less is contained in an amount of 0.15 mass % or more, the function as the metal detergent can be thoroughly exhibited, and the high-temperature oxidation stability can be more enhanced. When it is controlled to 3.0 mass % or less, the function corresponding to the addition amount can be exhibited.

When the lubricating oil composition contains both the basic sodium sulfonate having a TBN of 200 mgKOH/g or more and the basic calcium sulfonate having a TBN of 50 mgKOH/g or less as the component (A2), it is suitable that the blending amount of the basic sodium sulfonate having a TBN of 200 mgKOH/g or more is smaller than the blending amount of the basic calcium sulfonate having a TBN of 50 mgKOH/g or less.

A total sum of the contents of the component (A2) is suitably smaller than the aforementioned content of the component (A1), and it is preferably about 0.2 to 4.0 mass %, and more preferably about 0.5 to 2.5 mass %.

The calcium content is regulated to preferably 500 to 3,000 ppm, more preferably 800 to 2,500 ppm, and still more preferably 1,000 to 2,300 ppm on a mass basis in the lubricating oil composition, with incorporating the component (A) as described above.

The sodium content is regulated to preferably 100 to 1,200 ppm, more preferably 200 to 1,000 ppm, and still more preferably 200 to 800 ppm on a mass basis in the lubricating oil composition, with incorporating the basic sodium sulfonate as the component (A2).

A ratio of the calcium content to the sodium content (Ca/Na ratio) is preferably 1.5 to 7, more preferably 2 to 6, and still more preferably 2.5 to 4. When the Ca/Na ratio falls within the foregoing range, the high-temperature oxidation stability is enhanced, and the desired fuel consumption reducing properties are easily realized.

[Component (B)]

The organic molybdenum compound as the component (B) includes a binuclear organic molybdenum compound and/or a trinuclear organic molybdenum compound. In the present invention, the binuclear organic molybdenum compound is represented by the following general formula (I), and the trinuclear organic molybdenum compound is represented by the following general formula (II).

(I)

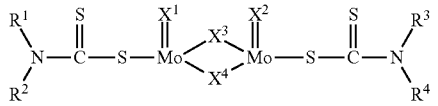

In the formula (I), each of $R^1$ to $R^4$ represents a hydrocarbon group having 4 to 22 carbon atoms, and $R^1$ to $R^4$ may be the same as or different from each other. When the number of the carbon atoms is 3 or less, the binuclear organic molybdenum compound has poor oil solubility. When the number of the carbon atoms is 23 or more, the binuclear organic molybdenum compound has such a high melting point that it is difficult to handle and has poor friction-reducing ability. From these viewpoints, the number of the carbon atoms is preferably 4 to 18, and more preferably 8 to 13. Examples of the hydrocarbon group include an alkyl group, an alkenyl group, an alkylaryl group, a cycloalkyl group, and a cycloalkenyl group. A branched or linear alkyl group or alkenyl group is preferred, and a branched or linear alkyl group is more preferred. Examples of the branched or linear alkyl group having 8 to 13 carbon atoms include an n-octyl group, a 2-ethylhexyl group, an isononyl group, an n-decyl group, an isodecyl group, a dodecyl group, a tridecyl group, an isotridecyl group, and the like. From the viewpoints of solubility in the base oil, storage stability, and friction-reducing ability, it is preferred that $R^1$ and $R^2$ are the same alkyl group, $R^3$ and $R^4$ are the same alkyl group, and the alkyl groups of $R^1$ and $R^2$ and the alkyl groups of $R^3$ and $R^4$ are different from each other.

In the formula (I), each of $X^1$ to $X^4$ represents a sulfur atom or an oxygen atom, and $X^1$ to $X^4$ may be the same as or different from each other. A ratio between the sulfur atom and the oxygen atom in the formula (I) is preferably 1/3 to 3/1, and more preferably 1.5/2.5 to 3/1 in terms of (sulfur atom)/(oxygen atom). When the ratio falls within the foregoing range, good performances are obtainable in view of corrosion resistance and solubility in the base oil. All of $X^1$ to $X^4$ may be a sulfur atom or an oxygen atom.

$$Mo_3S_kL_nQ_z \quad \text{(II)}$$

In the general formula (II), each of Ls independently represents a selected ligand having an organic group containing a carbon atom; n is 1 to 4; k varies between 4 and 7; each of Qs is independently selected from the group consisting of neutral electron donating compounds, such as water, an amine, an alcohol, an ether, and the like; and z is in the range of from 0 to 5 and includes non-stoichiometric values. At least 21 carbon atoms, such as at least 25 carbon atoms, at least 30 carbon atoms, or at least 35 carbon atoms, should be present in total in all the organic groups of the ligands in order to render the compound oil-soluble.

The ligand is, for example, selected from the group consisting of the following ligands and mixtures thereof.

[Chem. 4]

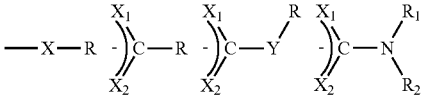

In these formulae, each of X, $X_1$, $X_2$, and Y is independently selected from the group consisting of oxygen and sulfur; and each of $R_1$, $R_2$, and R is independently selected from hydrogen and an organic group and may be the same as or different from each other.

Preferably, the aforementioned organic group is a hydrocarbyl group, such as an alkyl group, an aryl group, a substituted aryl group, an ether group, etc. (in which the carbon atom bonded to the residue of the ligand is, for example, primary or secondary). More preferably, each ligand has the same hydrocarbyl group.

The term "hydrocarbyl" refers to a substituent having a carbon atom directly bonded to the residue of the ligand, and is predominantly hydrocarbyl in properties in the scope of the present invention. Such a substituent includes the following:

1. Hydrocarbon substituents, that is, aliphatic substituents (for example, alkyl or alkenyl), alicyclic substituents (for example, cycloalkyl or cycloalkenyl), aromatic group-, aliphatic group-, or alicyclic group-substituted aromatic nuclei, and the like; and cyclic groups in which the ring is completed through another portion of the ligand (that is, arbitrary two indicated substituents may together form an alicyclic group).

2. Substituted hydrocarbon substituents, that is, those containing a non-hydrocarbon group that does not alter the predominantly hydrocarbyl properties of the substituent in the scope of the present invention. Examples of the non-hydrocarbon group include halo, such as chloro, fluoro, etc., amino, alkoxy, mercapto, alkylmercapto, nitro, nitroso, sulfoxy, and the like.

What is important is that the organic groups of the ligands have a sufficient number of carbon atoms to impart oil solubility to the aforementioned compound. For example, the number of carbon atoms in each group generally ranges between 1 and about 100, preferably between 1 and 30, and more preferably between 4 and 20. Preferred examples of the ligand include an alkylxanthate salt, a carboxylate salt, a dialkyldithiocarbamate salt, and a mixture thereof. A dialkyklithiocarbamate salt is most preferred. Those skilled in the art will recognize that the formation of the aforementioned compound requires selection of a ligand having an appropriate charge so as to balance the core's charge (as discussed below).

Compounds having the formula: $Mo_3S_kL_nQ_z$ have cationic cores surrounded by anionic ligands, and the cationic cores are represented by structures having net charges of +4 as shown below.

[Chem. 5]

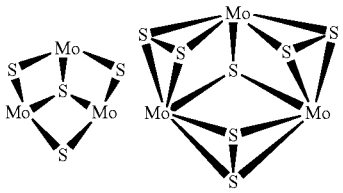

Thus, in order to solubilize these cores, the total charge among all the ligands must be −4. Four monoanionic ligands are preferred. Without wishing to be bound by any theory, two or more trinuclear cores may be bonded to one or more ligands or interconnected by one or more ligands, and the ligands may be polyvalent (i.e., have multiple connections to one or more cores). Oxygen and/or selenium may be substituted for sulfur in the cores.

An oil-soluble trinuclear organic molybdenum compound is preferred. The oil-soluble trinuclear organic molybdenum compound can be prepared by allowing a molybdenum source, such as $(NH_4)_2Mo_3S_{13}.n(H_2O)$ (wherein n varies between 0 and 2 and includes non-stoichiometric values), etc., to react with an appropriate ligand source, such as a tetralkylthiuram disulfide, etc., in an appropriate liquid/solvent. Another oil soluble trinuclear molybdenum compound may be formed by allowing a molybdenum source, such as $(NH_4)_2Mo_3S_{13}.n(H_2O)$, etc.; a ligand source, such as a tetralkylthiuram disulfide, a dialkyldithiocarbamic acid, etc.; and a sulfur-abstracting agent, such as a cyanide ion, a sulfite ion, etc., to react with each other in an appropriate solvent. Alternatively, an oil-soluble trinuclear molybdenum compound may also be formed by allowing a trinuclear molybdenum-sulfur halide salt, such as $[M']_2[Mo_3S_7A_6]$ (wherein M' is a counter ion, and A is a halogen, such as Cl, Br, I, etc.) to react with a ligand source, such as a dialkyldithiocarbamic acid, etc., in an appropriate liquid/solvent. The appropriate liquid/solvent may be, for example, aqueous or organic.

The selected ligand must have a sufficient number of carbon atoms to render the aforementioned compound soluble in the lubricating oil composition. The term "oil-soluble" as used in the present specification does not necessarily mean that the compounds or additives are fully dissolved in the oil. Such a term means that those compounds or additives are dissolved at the time of use, transportation, and storage.

When the binuclear and/or trinuclear organic molybdenum compound is used together with the aforementioned specified metal-based detergent (the component (A1) and the component (A2)) and a specified viscosity index improver (component (C)) as described later, in a lubricating oil composition having a low HTHS viscosity value as in the present invention, friction properties can be improved to realize reduction of fuel consumption while maintaining the enhanced high-temperature oxidation stability and detergency.

In the present invention, the total content of molybdenum derived from the binuclear and trinuclear organic molybdenum compounds in the lubricating oil composition is 0.025 mass % or more on the basis of the whole amount of the composition. When the content is less than 0.025 mass %, the driving torque at low engine rotation increases, making it difficult to realize the reduction of fuel consumption. In addition, when the content is less than 0.025 mass %, the driving torque at low engine rotation cannot be reduced even when an organic molybdenum compound other than the binuclear and trinuclear organic molybdenum compounds, such as a mononuclear organic molybdenum compound shown below, is contained to increase the molybdenum content in the composition.

The lubricating oil composition may contain a mononuclear organic molybdenum compound therein in addition to the aforementioned binuclear and/or trinuclear organic molybdenum compounds. The mononuclear organic molybdenum compound is not capable of reducing the driving torque at low engine rotation when used singly, but when it is used in combination with the aforementioned binuclear and/or trinuclear organic molybdenum compound, driving torque at low engine rotation can be reduced to improve the fuel consumption reducing properties and the high-temperature oxidation stability can be enhanced to prevent an increase in viscosity.

As the mononuclear organic molybdenum compound, a mononuclear organic molybdenum compound including a compound of the following general formula (III) and/or a compound of the following general formula (IV) is exemplified. A mixture of the compound of the general formula (III) and the compound of the general formula (IV) can be obtained by successively reacting a fatty oil, diethanolamine, and a molybdenum source through a condensation method disclosed in, for example, JP 62-108891 A.

(III)

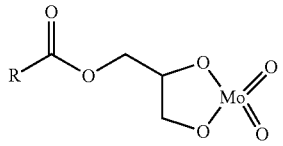

(IV)

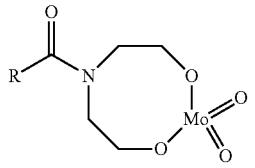

In the formulae (III) and (IV), R represents a fatty oil residue, and the fatty oil is a glycerol ester of a higher fatty acid which contains at least 12 carbon atoms and may contain 22 or more carbon atoms. Such an ester is generally known as vegetable and animal oils and fats. Examples of the useful vegetable oils and fats are derived from coconut, corn, cotton seeds, linseed oil, peanuts, soybeans, and sunflower kernels. Similarly, animal oils and fats, such as tallow, etc., may be used.

The molybdenum source may be an oxygen-containing molybdenum compound capable of reacting with an intermediate reaction product of the fatty oil and the diethanolamine to form an ester-type molybdenum complex. In particular, examples of the molybdenum source include ammonium molybdate, molybdenum oxide, and a mixture thereof.

As other mononuclear organic molybdenum compounds, a compound obtained by reacting a hexavalent molybdenum compound, specifically molybdenum trioxide and/or molybdic acid, with an amine compound, for example, a compound obtained by a production method described in JP 2003-252887 A, may also be used. The amine compound which is allowed to react with the hexavalent molybdenum compound is not particularly limited, and specifically, examples thereof include a monoamine, a diamine, a polyamine, and an alkanolamine. More specifically, examples of the amine compound may include an alkylamine having an alkyl group having 1 to 30 carbon atoms (the alkyl group may be either linear or branched), such as methylamine, ethylamine, dimethylamine, diethylamine, methylethylamine, methylpropylamine, etc.; an alkenylamine having an alkenyl group having 2 to 30 carbon atoms (the alkenyl group may be either linear or branched), such as ethenylamine, propenylamine, butenylamine, octenylamine, oleylamine, etc.; an alkanolamine having an alkanol group having 1 to 30 carbon atoms (the alkanol group may be either linear or branched), such as methanolamine, ethanolamine, methanolethanolamine, methanolpropanolamine, etc.; an alkylenediamine having an alkylene group having 1 to 30 carbon atoms, such as methylenediamine, ethylenediamine, propylenediamine, butylenediamine, etc.; a polyamine, such as diethylenetriamine, triethylenetetramine, tetraethylenepentamine, pentaethylenehexamine, etc.; compounds, such as undecyldiethylamine, undecyldiethanolamine, dodecyldipropanolamine, oleyldiethanolamine, oleylpropylenediamine, stearyltertraethylenepentamine, etc., which are the aforementioned monoamines, diamines or polyamines into which alkyl or alkenyl group(s) having 8 to 20 carbon atoms is further introduced; a heterocyclic compound, such as imidazoline etc.; an alkylene oxide adduct of such a compound; a mixture thereof; and the like.

Examples of the mononuclear organic molybdenum compound may include a sulfur-containing molybdenum complex of a succinimide described in JP 3-22438 B and JP 2004-2866 A; and the like.

The lubricating oil composition of the present invention contains the organic molybdenum compound in an amount of preferably 0.04 to 0.1 mass %, and more preferably 0.05 to 0.09 mass % in terms of a sum total of all molybdenum contents relative to the whole amount of the composition. When the content is 0.04 mass % or more, the friction-reducing properties can be improved to realize fuel consumption reducing properties. When the content is 0.1 mass % or less, the effect corresponding to the content can be exhibited.

Of this content, the total content of molybdenum derived from the mononuclear organic molybdenum compound is preferably 0.075 mass % or less, more preferably 0.015 to 0.07 mass %, and especially preferably 0.05 to 0.07 mass % on the basis of the whole amount of the composition. When the content of molybdenum derived from the mononuclear organic molybdenum compound falls within the foregoing range, the use of the mononuclear organic molybdenum compound in combination with the binuclear and/or trinuclear organic molybdenum compound can sufficiently enhance the friction reducing properties of the lubricating oil composition.

In addition, when the mononuclear organic molybdenum compound and the binuclear and/or trinuclear organic molybdenum compound are used in combination, the high-temperature oxidation stability, the detergency, and the friction reducing properties may be enhanced, and the reduction of fuel consumption may be realized, even if the content of molybdenum derived from the binuclear and/or trinuclear organic molybdenum compound is made small by reducing the blending amount thereof, for example, made smaller than the content of molybdenum derived from the mononuclear organic molybdenum compound. Specifically, the total content of molybdenum derived from the binuclear and trinuclear organic molybdenum compounds may be about 0.025 to 0.05 mass % when used in combination with the mononuclear organic molybdenum compound.

On the other hand, when no mononuclear organic molybdenum compound is used, it is better to increase the total content of the binuclear and trinuclear organic molybdenum compounds and regulate the total content to 0.04 mass % or more. The total content is preferably 0.04 to 0.1 mass %, and more preferably 0.05 to 0.09 mass %.

[Component (C)]

As the component (C) which is contained in the lubricating oil composition, a polyalkyl (meth)acrylate having an SSI of 30 or less is used. The term "SSI" means a shear stability index and expresses an ability of a polymer (component (C)) to resist decomposition. As the SSI is higher, the polymer is more unstable and decomposed more easily under shear.

$$SSI = \frac{Kv_0 - Kv_1}{Kv_0 - Kv_{oil}} \times 100 \quad \text{[Math. 1]}$$

The SSI is an indication of a decrease in viscosity under shear derived from the polymer in percentage and is calculated using the aforementioned calculation formula. In the formula, $Kv_0$ represents a value of kinematic viscosity at 100° C. of a mixture of a base oil and a polyalkyl (meth) acrylate added thereto. $Kv_1$ represents a value of kinematic viscosity at 100° C. measured after passing the mixture of a base oil and a polyalkyl (meth)acrylate added thereto through a high-shear Bosch diesel injector for 30 cycles according to the procedures of ASTM D6278. $Kv_{oil}$ denotes a value of kinematic viscosity at 100° C. of the base oil. As the base oil, a Group II base oil having a kinematic viscosity at 100° C. of 5.35 $mm^2/s$ and a viscosity index of 105 is used.

In the present invention, the wear prevention properties of the lubricating oil composition can be enhanced by using a polyalkyl (meth)acrylate having an SSI of 30 or less as a viscosity index improver. In addition, the use of the polyalkyl (meth)acrylate in combination with the aforementioned specified metal-based detergent and friction modifier (components (A) and (B)) can enhance the fuel consumption reducing properties while enhancing the high-temperature oxidation stability and the detergency of the lubricating oil composition.

The SSI of the component (C) is preferably 1 to 25. When the SSI is 25 or less, the wear prevention properties of the lubricating oil composition can be enhanced.

A monomer that constitutes the polyalkyl (meth)acrylate of the component (C) is an alkyl (meth)acrylate, and preferably an alkyl (meth)acrylate having a linear alkyl group having 1 to 18 carbon atoms or a branched alkyl group having 3 to 34 carbon atoms.

Examples of the preferred monomer that constitutes the alkyl (meth)acrylate include methyl (meth)acrylate, ethyl (meth)acrylate, propyl (meth)acrylate, butyl (meth)acrylate, pentyl (meth)acrylate, hexyl (meth)acrylate, hexyl (meth) acrylate, heptyl (meth)acrylate, octyl (meth)acrylate, nonyl (meth)acrylate, decyl (meth)acrylate, and the like. Two or more of these monomers may be used to form a copolymer. The alkyl group of these monomers may be either linear or branched.

The polyalkyl (meth)acrylate has a weight average molecular weight (a) of preferably 10,000 to 1,000,000, and more preferably 30,000 to 500,000. When the polyalkyl (meth)acrylate has a molecular weight falling within this range, its SSI can be easily adjusted to 30 or less.

The weight average molecular weight is a value measured by GPC using polystyrene as a calibration curve. In detail, the weight average molecular weight is measured under the following conditions.

Column: Two TSK gel GMH6 columns
Measurement temperature: 40° C.
Sample solution: 0.5 mass % THF solution
Detector: Refractive index detector
Standard: Polystyrene The lubricating oil composition contains the polyalkyl (meth)acrylate having an SSI of 30 or less in an amount of preferably 2 to 20 mass %, and more preferably 5 to 15 mass % on the basis of the whole amount of the composition. When the content of the component (C) falls within the forgoing range, the viscosity of the lubricating oil composition can be easily adjusted to a desired value.

[Other Components]

The lubricating oil composition may also be one which further contains other component(s) than the aforementioned components (A) to (C). Examples of the other components include a friction modifier that also functions as an antioxidant, such as a zinc dialkyldithiophosphate, an antioxidant of various types, an ashless dispersant, an ashless friction modifier, a metal deactivator, a pour-point depressant, an antifoaming agent, and the like.

As the zinc dialkyklithiophosphate, a zinc dialkyklithiophosphate having a primary or secondary alkyl group having 3 to 22 carbon atoms or an alkylaryl group substituted with an alkyl group having 3 to 18 carbon atoms is used. These compounds may be used singly or in combination of two or more kinds.

Examples of the antioxidant which is contained in the lubricating oil composition include an amine-based antioxidant, a phenol-based antioxidant, a sulfur-based antioxidant, a phosphorus-based antioxidant, and the like. An arbitrary appropriate antioxidant selected from known antioxidants which are conventionally used as an antioxidant for lubricating oils may be used.

Examples of the amine-based antioxidant include a diphenylamine-based antioxidant, such as diphenylamine, an alkylated diphenylamine having an alkyl group having 3 to 20 carbon atoms, etc.; and a naphthylamine-based antioxidant, such as α-naphthylamine, a $C_3$ to $C_{20}$ alkyl-substituted phenyl-α-naphthylamine, etc.

Examples of the phenol-based antioxidant include an monophenol-based antioxidant, such as 2,6-di-tert-butyl-4-methylphenol, 2,6-di-tert-butyl-4-ethylphenol, octadecyl-3-(3,5-di-tert-butyl-4-hydroxyphenyl)propionate, etc.; a diphenol-based antioxidant, such as 4,4'-methylenebis(2,6-di-tert-butylphenol), 2,2'-methylenebis(4-ethyl-6-tert-butylphenol), etc.; and the like.

Examples of the sulfur-based antioxidant include dilauryl-3,3'-thiodipropionate and the like, and examples of the phosphorus-based antioxidant include a phosphite and the like.

These antioxidants may be contained singly or in an arbitrary combination of plural kinds, and in general, a combined use of two or more kinds is preferred.

Examples of the ashless dispersant include polybutenylsuccinimide, polybutenylbenzylamine, and polybutenylamine, each of which has a polybutenyl group having a number average molecular weight of 900 to 3,500, and a derivative thereof, such as a boric acid-modified product thereof, etc., and the like. These ashless dispersants may be contained singly or in an arbitrary combination of plural kinds.

As the ashless friction modifier, an ester-based friction modifier, for example, a partial ester compound obtained through a reaction of a fatty acid with an aliphatic polyhydric alcohol, etc., is used. The fatty acid is preferably a fatty acid having a linear or branched hydrocarbon group having 6 to 30 carbon atoms, and the carbon number of the hydrocarbon group is more preferably 8 to 24, and especially preferably 10 to 20. The aliphatic polyhydric alcohol is a dihydric to hexahydric alcohol, and examples thereof include ethylene glycol, glycerin, trimethylolpropane, pentaerythritol, sorbitol, and the like.

Examples of the metal deactivator include benzotriazole, a triazole derivative, a benzotriazole derivative, a thiadiazole derivative, and the like.

Examples of the pour-point depressant include an ethylene-vinyl acetate copolymer, a condensation product of a chlorinated paraffin and naphthalene, a condensation product of a chlorinated paraffin and phenol, a polymethacrylate, a polyalkylstyrene, and the like. In particular, a polymethacrylate is preferably used.

Examples of the antifoaming agent include dimethylpolysiloxane, a polyacrylate, and the like.

[Production Method of Lubricating Oil Composition]

The production method of a lubricating oil composition according to the present invention is concerned with the production of a lubricating oil composition by blending the aforementioned components (A) to (C) in the lubricating base oil. In addition, in the production method of a lubricating oil composition according to the present invention, the other component(s) may be blended in the lubricating oil as well as the components (A) to (C).

The lubricating base oil, the aforementioned components (A) to (C), and other component(s) are the same as those described above, and the lubricating oil composition obtained by the production method of the present invention is described previously. Thus, their descriptions are omitted.

In the present production method, the aforementioned components (A) to (C), and other component(s) may be blended in the lubricating base oil by any method, and a method thereof is not limited.

EXAMPLES

Next, the present invention is described in more detail by reference to Examples, but it should be construed that the present invention is by no means limited by these Examples.

Various properties of lubricating oil compositions and base oils shown in the present specification were determined according to the following procedures.

(1) Kinematic Viscosity

The kinematic viscosity was measured using a glass capillary viscometer in conformity with JIS K2283-1983.

(2) Viscosity Index

The viscosity index was measured in conformity with JIS K2283.

(3) NOACK Value

The NOACK value was measured in conformity with the method prescribed in ASTM D5800.

(4) High-Temperature High-Shear Viscosity (HTHS Viscosity)

The high-temperature high-shear viscosity was measured by the method of ASTM D4683 and ASTM D6616 using a TBS viscometer (tapered bearing simulator viscometer). The test conditions are shown below.

Shear rate: $10^6$ $sec^{-1}$

Rotational speed (motor): 3,000 rpm

Clearance (rotor/stator): 3 μm

Oil temperature: 100° C. and 150° C.

The methods for evaluating the lubricating oil compositions in each of the Examples and Comparative Example are as follows.

(1) Motoring Driving Torque

The camshaft of an SOHC engine with a 2 L displacement was driven by a motor using the lubricating oil composition of each of the Examples and Comparative Example, and the torque that was applied to the camshaft on that occasion was measured. The measured value was evaluated as a motoring driving torque. At this time, the rotational speed of the camshaft and the engine oil temperature were adjusted to 550 rpm and 100° C., respectively.

(2) Wear Prevention Properties Test

The wear prevention properties of the lubricating oil composition were determined by measuring the kinematic viscosity at 100° C. after applying a shear to the lubricating oil composition 30 times in a diesel injector in conformity with ASTM D6287-07. As the kinematic viscosity at 100° C. is lower, the wear prevention properties become lower.

(3) High-Temperature Oxidation Stability Test

The lubricating oil composition was subjected to high-temperature oxidation in conformity with the method of NOACK (250° C., 4 hours). The kinematic viscosity (40° C.) before and after the high-temperature oxidation was measured, thereby determining a rate of increase in kinematic viscosity (40° C.).

(4) Hot Tube Test

The measurement was performed by setting the test temperature to 300° C. and making other conditions in conformity with those of JPI-5S-55-99. Conforming to JPI-5S-55-99, a glass tube after the test was evaluated at 0.5 intervals between point 0 (black) and point 10 (colorless) and evaluated on 21 grades. It is meant that as the numerical value is higher, the detergency becomes better.

Examples 1 to 5 and Comparative Example 1

The components (A) to (C) and other components were blended in the lubricating base oil as shown in Table 1, thereby preparing the lubricating oil composition of each of the Examples and Comparative Example containing the lubricating base oil and these respective components. Properties of the lubricating oil compositions were then measured. In addition, the lubricating oil composition of each of the Examples and Comparative Example was evaluated according to the aforementioned evaluation methods.

TABLE 1

| | | | Example | | | | | Comparative Example |
|---|---|---|---|---|---|---|---|---|
| | | | 1 | 2 | 3 | 4 | 5 | 1 |
| Blending composition (mass %) | Lubricating base oil | | Balance | Balance | Balance | Balance | Balance | Balance |
| | (A) | Metal-based detergent 1 | 1.90 | 2.10 | 2.40 | 1.90 | 1.90 | 2.60 |
| | | Metal-based detergent 2 | 0.26 | 0.26 | — | 0.26 | 0.26 | — |
| | | Metal-based detergent 3 | 0.70 | — | 0.70 | 0.70 | 0.70 | — |
| | (B) | Binuclear molybdenum compound | 0.70 | 0.70 | 0.70 | — | 0.25 | 0.70 |
| | | Trinuclear molybdenum compound | — | — | — | 1.33 | — | — |
| | | Mononuclear molybdenum compound | — | — | — | — | 0.75 | — |
| | (C) | Viscosity index improver | 7.15 | 7.15 | 7.15 | 7.15 | 7.15 | 7.15 |
| | Other component | ZnDTP | 1.00 | 1.00 | 1.00 | 1.00 | 1.00 | 1.00 |
| | | Amine-based antioxidant | 1.00 | 1.00 | 1.00 | 1.00 | 1.00 | 1.00 |
| | | Phenol-based antioxidant | 0.50 | 0.50 | 0.50 | 0.50 | 0.50 | 0.50 |
| | | Polybutenylsuccinbisimide | 3.50 | 3.50 | 3.50 | 3.50 | 3.50 | 3.50 |
| | | Ester-based friction modifier | 0.30 | 0.30 | 0.30 | 0.30 | 0.30 | 0.30 |
| | | Other additives | 1.20 | 1.20 | 1.20 | 1.20 | 1.20 | 1.20 |

TABLE 1-continued

| | | Example | | | | | Comparative Example |
|---|---|---|---|---|---|---|---|
| | | 1 | 2 | 3 | 4 | 5 | 1 |
| Ca amount (mass ppm) | | 1,650 | 1,640 | 2,040 | 1,650 | 1,650 | 2,030 |
| Na amount (mass ppm) | | 510 | 510 | 0 | 510 | 510 | 0 |
| Ca/Na ratio | | 3.2 | 3.2 | — | 3.2 | 3.2 | — |
| Properties of composition | Kinematic viscosity (40° C.) ($mm^2/s$) | 30.66 | 30.25 | 30.74 | 31.36 | 32.13 | 30.33 |
| | Kinematic viscosity (100° C.) ($mm^2/s$) | 6.878 | 6.855 | 6.854 | 6.973 | 7.061 | 6.830 |
| | Viscosity index | 195 | 197 | 193 | 193 | 191 | 195 |
| | HTHS viscosity (100° C.) (mPa · s) | 4.57 | 4.51 | 4.55 | 4.59 | 4.59 | 4.53 |
| | HTHS viscosity (150° C.) (mPa · s) | 2.32 | 2.29 | 2.31 | 2.33 | 2.30 | 2.30 |
| | NOACK (250° C., 1 Hr) (mass %) | 14.4 | 14.2 | 14.2 | 14.1 | 14.1 | 14.2 |
| | Mo amount derived from binuclear and trinuclear Mo (mass %) | 0.070 | 0.070 | 0.070 | 0.070 | 0.025 | 0.070 |
| | Mo amount derived from mononuclear Mo (mass %) | — | — | — | — | 0.059 | — |
| | Mo total amount (mass %) | 0.070 | 0.070 | 0.070 | 0.070 | 0.084 | 0.070 |
| Motoring driving torque (N · m) | | 8.75 | 8.73 | 8.79 | 8.84 | 8.93 | 8.77 |
| Wear prevention properties test: Kinematic viscosity at 100° C. ($mm^2/s$) | | 6.27 | 6.24 | 6.25 | 6.36 | 6.44 | 6.23 |
| High-temperature oxidation stability test: Rate of increase in kinematic viscosity (%) | | 42 | 47 | 53 | 45 | 41 | 85 |
| Hot tube test (300° C.): Grade | | 9.5 | 9.0 | 8.5 | 9.5 | 9.5 | 6.5 |

* The respective components in Table 1 are as follows.

(1) Lubricating base oil

Base oil: Group III 100N hydrorefined base oil, kinematic viscosity at 100° C.; 4.2 $mm^2/s$, viscosity index; 132, NOACK value (250° C., 1 hr); 13.5 mass %, n-d-M ring analysis % Cp.; 85.5%

(2) Metal-based detergent (component (A))

Metal-based detergent 1: Basic calcium salicylate, TBN (perchloric acid method); 225 mgKOH/g, calcium content; 7.8 mass %, sulfur content; 0.2 mass %

Metal-based detergent 2: Basic sodium sulfonate, TBN (perchloric acid method); 450 mgKOH/g, sodium content; 19.5 mass %, sulfur content; 0.3 mass %

Metal-based detergent 3: Basic calcium sulfonate, TBN (perchloric acid method); 17 mgKOH/g, calcium content; 2.4 mass %, sulfur content; 3.2 mass %

(3) Organic molybdenum compound (component (B))

Binuclear molybdenum compound: Trade name SAKURA-LUBE 515 (manufactured by ADEKA Corporation), binuclear molybdenum dithiocarbamate represented by the general formula (I), wherein each of $R^1$ to $R^4$ has 8 or 13 carbon atoms, and each of $X^1$ to $X^4$ is an oxygen atom, molybdenum content; 10.0 mass %, sulfur content; 11.5 mass %

Trinuclear molybdenum compound: Trade name Infineum C9455B (manufactured by INFINEUM Ltd.), trinuclear molybdenum dithiocarbamate represented by the general formula (II), molybdenum content; 5.27 mass %, sulfur content; 9.04 mass %

Mononuclear molybdenum compound: Trade name: MOLYVAN 855 (manufactured by R. T. Vanderbilt Company Inc.), a mixture of [2,2'-(dodecanoylimino)diethanolato] dioxomolybdenum(VI) and [3-(dodecanoyloxy)-1,2-propanediolato]dioxomolybdenum(VI), molybdenum content; 7.9 mass %, nitrogen content; 2.8 mass %

(4) Viscosity index improver (component (C))

Viscosity index improver: Polyalkyl (meth)acrylate, mass average molecular weight 380,000, SSI = 20

(5) Others

Zinc dialkyldithiophosphate (ZnDTP): Zinc content; 9.0 mass %, phosphorus content; 8.2 mass %, sulfur content; 17.1 mass %, alkyl group; a mixture of a secondary butyl group and a secondary hexyl group Amine-based antioxidant: Dialkyldiphenylamine, nitrogen content; 4.62 mass %

Phenol-based antioxidant: Octadecyl-3-(3,5-di-tert-butyl-4-hydroxyphenyl)propionate Polybutenylbissuccinimide: Number average molecular weight of polybutenyl group; 2,300, nitrogen content; 1.0 mass %, chlorine content; 0.01 mass % or less Ester-based friction modifier: Glycerin monooleate As the other additives shown in Table 1, a metal deactivator, a pour-point depressant, and an antifoaming agent were blended.

As is clear from the results shown in Table 1, the lubricating oil composition of each of the Examples had a decreased viscosity and reduced motoring driving torque. In addition, as is clear from the results of the wear prevention properties test, the lubricating oil composition of each of the Examples was able to prevent wear caused by shear and to realize reduction of fuel consumption and high wear prevention properties. Furthermore, as is clear from the results of the high-temperature oxidation stability test and the hot tube test, the lubricating oil composition of each of the Examples was able to enhance both the high-temperature oxidation stability and the detergency. In contrast, the lubricating oil composition of Comparative Example 1, in which the component (A2) of the present invention was not blended, could not enhance the high-temperature oxidation stability and the detergency.

INDUSTRIAL APPLICABILITY

The lubricating oil composition for an internal combustion engine according to the present invention is improved in high-temperature oxidation stability and detergency while realizing fuel consumption reducing properties and high wear prevention properties and can be used advantageously in internal combustion engines, especially in internal combustion engines having high fuel efficiency.

The invention claimed is:

1. A lubricating oil composition for an internal combustion engine, the composition comprising a lubricating base oil and:

(A1) a basic calcium salicylate having a total base number, as measured by a perchloric acid method, of 200 mgKOH/g or more in an amount of from 1.0 mass % to 3.5 mass % relative to the whole amount of the composition;

(A2) a basic sodium sulfonate having a total base number, as measured by a perchloric acid method, of 300 mgKOH/g or more in an amount of from 0.1 mass % to 0.7 mass % relative to the whole amount of the composition and/or a basic calcium sulfonate having a total base number, as measured by a perchloric acid method, of 50 mgKOH/g or less in an amount of from 0.7 mass % to 3.0 mass % relative to the whole amount of the composition;

a total amount of component (A1) is greater than a total amount of component (A2);

the calcium content is regulated to 1,000 to 2.300 ppm on a mass basis in the lubricating oil composition;

wherein the sodium content is regulated to 200 to 800 ppm on a mass basis in the lubricating oil composition when the lubricating oil composition contains the basic sodium sulfonate; and wherein a ratio of the calcium content to the sodium content (Ca/Na) is from 2.5 to 4 when the lubricating oil composition contains the basic sodium sulfonate;

(B) a binuclear organic molybdenum compound represented by the following general formula (I) and/or a trinuclear organic molybdenum compound represented by the following general formula (II):

(I)

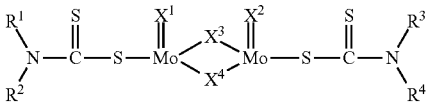

(II)

$Mo_3S_kL_nQ_z$;

and wherein all organic molybdenum compounds are contained in an amount of 0.04 to 0.1 mass % in terms of a molybdenum content relative to the whole amount of the composition;

(C) a polyalkyl (meth)acrylate having an SSI of from 1 to 25, wherein:

a total content of the polyalkyl (meth)acrylate (C) is from 2 to 20 mass % relative to the whole amount of the composition;

a total content of molybdenum derived from the binuclear and trinuclear organic molybdenum compounds is 0.025 mass % or more relative to the whole amount of the composition;

the lubricating oil composition has a high-temperature high-shear viscosity at 100° C. of 4.0 to 5.0 mPa·s, a high-temperature high-shear viscosity at 150° C. of 2.2 to 2.5 mPa·s, and a NOACK value (250° C., 1 hr) of 15 mass % or less;

each of $R^1$ to $R^4$ represents a hydrocarbon group having 4 to 22 carbon atoms, and $R^1$ to $R^4$ may be the same as or different from each other;

each of $X^1$ to $X^4$ represents a sulfur atom or an oxygen atom;

each of Ls independently represents a ligand having an organic group containing a carbon atom, and at least 21 carbon atoms are present in total in all the organic groups of the ligands;

n is 1 to 4;

k is 4 to 7;

Q represents a neutral electron donating compound; and z is 0 to 5 and includes non-stoichiometric values.

2. The lubricating oil composition according to claim 1, comprising at least the basic sodium sulfonate having a total base number, as measured by a perchloric acid method, of 300 mgKOH/g or more as the component (A2).

3. The lubricating oil composition according to claim 2, further comprising the basic calcium sulfonate having a total base number, as measured by a perchloric acid method, of 50 mgKOH/g or less as the component (A2).

4. The lubricating oil composition according to claim 1, further comprising a mononuclear organic molybdenum compound.

5. A method for producing a lubricating oil composition for an internal combustion engine, the method comprising blending:

(A1) a basic calcium salicylate having a total base number, as measured by a perchloric acid method, of 200 mgKOH/g or more in an amount of from 1.0 mass % to 3.5 mass % relative to the whole amount of the lubricating oil composition:

(A2) a basic sodium sulfonate having a total base number, as measured by a perchloric acid method, of 300 mgKOH/g or more in an amount of from 0.1 mass % to 0.7 mass % relative to the whole amount of the composition and/or a basic calcium sulfonate having a total base number, as measured by a perchloric acid method, of 50 mgKOH/g or less in an amount of from 0.7 mass % to 3.0 mass % relative to the whole amount of the composition;

B) a binuclear organic molybdenum compound represented by the following general formula (I) and/or a trinuclear organic molybdenum compound represented by the following general formula (II)):

(I)

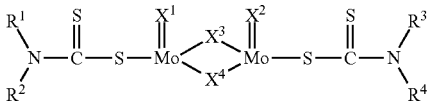

(II)

$Mo_3S_kL_nQ_z$;

and wherein all organic molybdenum compounds are contained in an amount of 0.04 to 0.1 mass % in terms of a molybdenum content relative to the whole amount of the composition;

(C) a polyalkyl (meth)acrylate having an SSI of from 1 to 25, wherein:

in the lubricating oil composition, a total amount of component (A1) is greater than a total amount of component (A2);

the calcium content is regulated to 1,000 to 2,300 ppm on a mass basis in the lubricating oil composition;

wherein the sodium content is regulated to 200 to 800 ppm on a mass basis in the lubricating oil composition when the lubricating oil composition contains the basic sodium sulfonate; and wherein a ratio of the calcium content to the sodium content (Ca/Na) is from 2.5 to 4 when the lubricating oil composition contains the basic sodium sulfonate; and a total content of the polyalkyl (meth)acrylate (C) is from 2 to 20 mass % relative to the whole amount of the lubricating oil composition;

a total content of molybdenum derived from the binuclear and trinuclear organic molybdenum compounds is 0.025 mass % or more relative to the whole amount of the composition;

the lubricating oil composition has a high-temperature high-shear viscosity at 100° C. of 4.0 to 5.0 mPa·s, a high-temperature high-shear viscosity at 150° C. of 2.2 to 2.5 mPa·s er less, and a NOACK value (250° C., 1 hr) of 15 mass % or less;

each of $R^1$ to $R^4$ represents a hydrocarbon group having 4 to 22 carbon atoms, and $R^1$ to $R^4$ may be the same as or different from each other;

each of $X^1$ to $X^4$ represents a sulfur atom or an oxygen atom;

each of Ls independently represents a ligand having an organic group containing a carbon atom, and at least 21 carbon atoms are present in total in all the organic groups of the ligands;

n is 1 to 4;

k is 4 to 7;

Q represents a neutral electron donating compound; and z is 0 to 5 and includes non-stoichiometric values.

6. A lubricating oil composition according to claim 1, having a kinematic viscosity at 100° C. of 7.061 $mm^2/s$ or less.

7. The lubricating oil composition according to claim 1, wherein the lubricating base oil has a viscosity index of 100 or more.

8. The lubricating oil composition according to claim 1, wherein the basic calcium sulfonate has a total base number of 10 to 30 mgKOH/g.

9. The lubricating oil composition according to claim 1, wherein $R^1$ to $R^4$ represent a hydrocarbon group having 4 to 18 carbon atoms.

10. The lubricating oil composition according to claim 1, wherein $X^1$ to $X^4$ is an oxygen atom.

11. The lubricating oil composition for an internal combustion engine of claim 1, wherein the basic calcium salicylate (A1) has a total base number, as measured by a perchloric acid method, of from 200 mgKOH/g to 500 mgKOH/g; and the basic sodium sulfonate (A2) has a total base number, as measured by a perchloric acid method, of 300 mgKOH/g to 500 mgKOH/g.

12. The method for producing a lubricating oil composition for an internal combustion engine according to claim 5, having a kinematic viscosity at 100° C. of 7.061 $mm^2/s$ or less.

13. The method for producing a lubricating oil composition for an internal combustion engine according to claim 5, wherein the lubricating base oil has a viscosity index of 100 or more.

14. The method for producing a lubricating oil composition for an internal combustion engine according to claim 5, wherein the basic calcium sulfonate has a total base number of 10 to 30 mgKOH/g.

15. The method for producing a lubricating oil composition for an internal combustion engine according to claim 5, wherein $R^1$ to $R^4$ represent a hydrocarbon group having 4 to 18 carbon atoms.

16. The method for producing a lubricating oil composition for an internal combustion engine according to claim 5, wherein $X^1$ to $X^4$ is an oxygen atom.

17. The method for producing a lubricating oil composition for an internal combustion engine according to claim 5, wherein the basic calcium salicylate (A1) has a total base number, as measured by a perchloric acid method, of from 200 mgKOH/g to 500 mgKOH/g; and the basic sodium sulfonate (A2) has a total base number, as measured by a perchloric acid method, of 300 mgKOH/g to 500 mgKOH/g.

18. The lubricating oil composition according to claim 1, wherein the total base number of the basic sodium sulfonate (A2) is 400 mgKOH/g or more.

19. The lubricating oil composition according to claim 1, wherein the calcium content is regulated to 1,000 to 2,040 ppm on a mass basis in the lubricating oil composition.

20. The method for producing a lubricating oil composition for an internal combustion engine according to claim 5, wherein the total base number of the basic sodium sulfonate (A2) is 400 mgKOH/g or more.

21. The method for producing a lubricating oil composition for an internal combustion engine according to claim 5, wherein the calcium content in the lubricating oil composition is regulated to 1,000 to 2,040 ppm on a mass basis in the lubricating oil composition.

* * * * *